US011945637B2

(12) United States Patent
Dunlap

(10) Patent No.: US 11,945,637 B2
(45) Date of Patent: Apr. 2, 2024

(54) VARIABLE VOLUME EVACUABLE CONTAINER

(71) Applicant: M. Lynn Dunlap, Twin Falls, ID (US)

(72) Inventor: M. Lynn Dunlap, Twin Falls, ID (US)

( * ) Notice: Subject to any disclaimer, the term of this patent is extended or adjusted under 35 U.S.C. 154(b) by 0 days.

(21) Appl. No.: 17/566,590

(22) Filed: Dec. 30, 2021

(65) Prior Publication Data

US 2023/0211937 A1 Jul. 6, 2023

(51) Int. Cl.
*B65D 81/20* (2006.01)
*B65D 43/02* (2006.01)
*B65D 51/24* (2006.01)

(52) U.S. Cl.
CPC ..... *B65D 81/2038* (2013.01); *B65D 43/0229* (2013.01); *B65D 51/242* (2013.01); *B65D 2543/00092* (2013.01); *B65D 2543/0049* (2013.01); *B65D 2543/00546* (2013.01)

(58) Field of Classification Search
CPC ..... B65D 39/02; B65D 39/08; B65D 81/2038
See application file for complete search history.

(56) References Cited

U.S. PATENT DOCUMENTS 1,426,501 A * 8/1922 Parizek ..... B65D 39/08 220/374
3,784,051 A * 1/1974 Shaw ..... B65D 25/06 220/580
4,492,313 A 1/1985 Touzani
4,629,098 A 12/1986 Eger
5,810,185 A 9/1998 Groesbeck
5,972,292 A * 10/1999 DeMeo ..... A45C 11/005 220/366.1
6,220,311 B1 4/2001 Litto
8,182,683 B1 5/2012 Allen
8,313,644 B2 11/2012 Harris et al.
8,318,011 B2 11/2012 O'Brien et al.
8,453,860 B2 6/2013 Otero
8,820,551 B2 9/2014 Arney
9,457,939 B1 10/2016 Peters
9,533,817 B2 * 1/2017 Smallwood ..... B65D 81/245
9,815,592 B2 11/2017 Diaz
9,845,178 B2 12/2017 Meinzinger
10,737,845 B2 8/2020 Hirst et al.
2015/0014365 A1 * 1/2015 Smith ..... B65D 83/0027 222/390

* cited by examiner

*Primary Examiner* — Jeffrey R Allen
(74) *Attorney, Agent, or Firm* — Burdick Patents, P.A.; Sean D. Burdick; Colin L. Honan

(57) ABSTRACT

A variable volume evacuable container has a closed bottom, an open top, and a spirally threaded inner wall extending therebetween. A lid configured to threadably engage the inner wall has a top surface, a perimeter, a bottom surface, and a funneling volume within the perimeter and below the bottom surface. A duct is defined through the top and bottom surfaces at the apex of the funneling volume, and a moveable baffle is coupled to the top surface to cover or uncover the duct. The bottom surface slopes continuously upward to the apex so that downward rotation of the lid against contained liquid forces air out of the duct until the liquid fills the funneling volume, allowing the baffle to seal the liquid from air by covering the duct.

15 Claims, 9 Drawing Sheets

20

SECTION B-B

24

22

DETAIL C

VARIABLE VOLUME EVACUABLE CONTAINER

BACKGROUND OF THE INVENTION

Field of the Invention

The present invention relates generally to containers for liquids, more specifically to evacuable beverage containers, and most specifically to a variable-volume evacuable wine container.

Description of Related Art

Container for liquids and specifically beverages are well known in the art and are produced in various shapes and sizes. Of particular relevance to the present disclosure are beverage containers constructed to provide a variable volume so that as the amount of liquid within the container becomes depleted, the containment volume can be adjusted to accommodate only the remaining volume of liquid. A common objective of this class of container is to prevent air from entering the container to replace the volume of evacuated liquid.

When air is allowed to accumulate within a beverage container, such as a partially depleted bottle of wine, the wine will begin to oxidize, even if the bottle is recorked. Oxidation of the wine will eventually turn acetaldehyde into acetic acid, leading to discoloration and conversion of the wine to vinegar. Many other liquids are also known to degrade or spoil when exposed to air, including milk, soft drinks, olive oil, etc.

One solution proposed by Otero in U.S. Pat. No. 8,453,860 provides a collapsible inner bladder within a rigid bottle. A ratcheting mechanism at the bottom of the bottle twists the inner bladder to reduce its volume in stages as liquid evacuates. Problems with this solution include the complexity of design, and the generation of waste material, i.e. the collapsible bladder. Another solution proposed by Diaz in U.S. Pat. No. 9,815,592 provides a moveable piston within an elongated shaft for containing a liquid. The piston is insertable at the bottom of the shaft, and is constructed with a series of flexible seals about its perimeter to create an air-tight seal when the piston is pushed upward into the shaft. As liquid is drawn out of the top of the shaft, the piston is drawn upward by the suction force. The main problem with this design is the eventual failure of the flexible seals, and inevitable leakage of the liquid through the bottom of the container due to hydrostatic pressure acting on the seals.

Another solution is provided in the form of a specialized tool manufactured by Coravin, Inc. of Bedford, Massachusetts. The Coravin® tool is a hand-held device that uses a clamp to drive an elongated hollow needle through the cork of a wine bottle to allow wine to be poured out through the needle. The device includes a small canister of compressed Argon gas that is configured to replace the extracted wine with an equivalent volume of the gas. The hollow needle is designed not to destroy the integrity of the cork, so that when the needle is removed, the cork reseals itself and prevents air from entering the wine bottle. Drawbacks of this system include the high cost of the tool (currently about $150), the cost of replacement gas cylinders, and the need to store, maintain, and periodically clean the specialized tool.

What is needed is an improvement in the elegance of design and efficiency of operation for a container that evacuates air away from contained liquid.

SUMMARY OF THE INVENTION

The present invention is an engineered design for a specialized container for liquid that allows the size of the containment volume to be adjusted to evacuate air from the container to minimize exposure of the contained liquid to air. Various embodiments of the invention disclosed herein operate to evacuate contained air by compression of a lid downward against the surface of contained liquid, to force air out of containment through an air passageway formed by the lid. The container is designed to leak a negligible amount of the liquid through the passageway, following evacuation of the air, to provide a visual indication to a user that substantially all of the air has been evacuated from the containment portion. The container is designed for upright storage of potable liquids, and is ideally suited for storage of wine. The container is also suitable for storing any type of liquid, especially liquids susceptible to detrimental exposure to air or other gases.

In one embodiment, a container according to the present invention includes a hollow cylinder having a closed bottom, an open top, and a spirally threaded inner wall extending between the closed bottom and the open top. A lid is configured to threadably engage the inner wall of the hollow cylinder. The lid further includes a top surface, a perimeter, a bottom surface having an apex elevated from the perimeter, and a funneling volume within the perimeter and below the bottom surface. A duct is defined through the top and bottom surfaces at the apex of the funneling volume, and a baffle is coupled to the top surface and moveable between first and second positions, so that the baffle in the first position covers the duct and in the second position uncovers the duct.

In other embodiments of the invention, the aforesaid container may include one or more additional features. For example, a handle may be formed on the top surface to provide a user with mechanical advantage when rotating the lid. The lid may be configured with a threaded side wall, and the open top of the container may form a spout having a height less than that of the threaded side wall. The threaded side wall may include threading having no greater than two spiral revolutions. The apex of the bottom surface may be substantially centrally located within the perimeter of the lid. The bottom surface may be substantially concave, or may be configured so that any minimum length path from the perimeter to the apex slopes continuously upward to the apex. In one embodiment, with the lid resting upright on a horizontal surface, the funneling volume is defined as space above the horizontal surface beneath the apex and within the perimeter, and may have a volume is substantially equivalent to about 8 fluid ounces.

In other embodiments of the invention, the container may further include an outer wall extending between the closed bottom and the open top, wherein the outer wall is at least partially corrugated. The container may be further configured to allow the lid when threadably engaged to the inner wall of the hollow cylinder to be rotated downward into the hollow cylinder until the perimeter of the lid contacts the closed bottom and to be rotated upward out of the hollow cylinder until the lid separates from the hollow cylinder.

In another embodiment, a variable volume liquid container includes a hollow vessel having a closed bottom, an open top, and an inner wall extending between the closed bottom and the open top. A lid is configured to move vertically within the hollow vessel while substantially sealing liquid contained within the vessel from exposure to air outside the vessel. The lid has a duct defined vertically through the lid, and is further configured to evacuate air from the hollow vessel through the duct by compression of the lid against the contained liquid. A baffle may be coupled to the lid, and may be moveable between first and second positions, so that the baffle in the first position covers the duct and in the second position uncovers the duct.

In other, more elaborate embodiments, the container may include a handle formed on the lid, or a spout formed at the open top. The lid may further include a top surface, a perimeter, and a bottom surface having an apex elevated from the perimeter, wherein the duct is defined through the top surface and the bottom surface at the apex. The apex may be substantially centrally located within the perimeter, the bottom surface may be substantially concave, or the bottom surface may be configured so that any minimum length path from the perimeter to the apex slopes continuously upward to the apex. In any of these embodiment, the container may be configured to allow the lid to be moved downward into the hollow vessel until the perimeter of the lid contacts the closed bottom, and to be moved upward from the closed bottom until the lid separates from the hollow vessel.

BRIEF DESCRIPTION OF THE DRAWINGS

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims. Component parts shown in the drawings are not necessarily to scale, and may be exaggerated to better illustrate the important features of the invention. Dimensions shown are exemplary only. In the drawings, like reference numerals may designate like parts throughout the different views, wherein:

DETAILED DESCRIPTION OF THE INVENTION

The following disclosure presents exemplary embodiments for a variable volume evacuable container. A container according to the present invention provides a containment volume for containing a liquid, and when containing the liquid, allows the size of the containment volume to be adjusted to evacuate air from the container to minimize exposure of the contained liquid to air. Embodiments of the container disclosed herein operate to evacuate contained air by compression of a lid downward against the surface of contained liquid, to force air out of containment through an air passageway formed by the lid. The container is designed to leak a negligible amount of the liquid through the passageway, following evacuation of the air, to provide a visual indication to a user that substantially all of the air has been evacuated from the containment portion. The container is designed for upright storage of potable liquids, and is ideally suited for storage of wine. The container is also suitable for storing any type of liquid, especially liquids susceptible to detrimental exposure to air or other gases.

Figure 1:
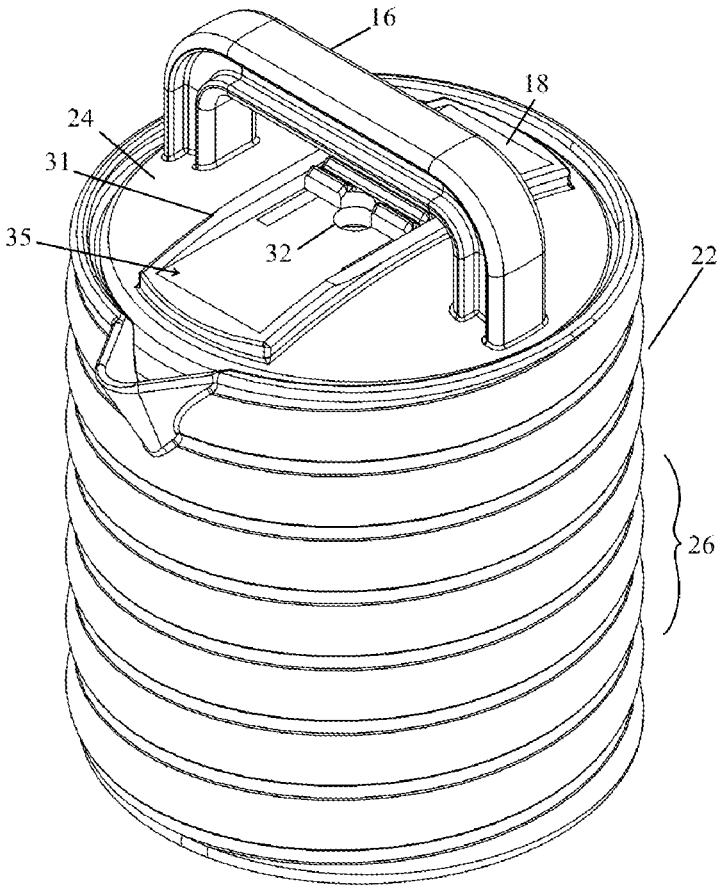
FIG. 1 is a perspective view of a variable volume evacuable container according to one embodiment of the present invention.

FIG. 1 shows a perspective view of a variable volume evacuable container 20 according to one embodiment of the present invention. Container 20 includes a vessel 22 that in this example has a generally cylindrical form, with an open top and a closed bottom, and an outer surface 26. A lid 24 covers the open top of container 20. The lid 24 includes a handle 16 and a moveable baffle 18. In one embodiment, the vessel 22 is formed from a non-corrosive metal such as aluminum or stainless steel, and the lid 24 is formed from a rigid, injection-moldable plastic.

Figure 2:
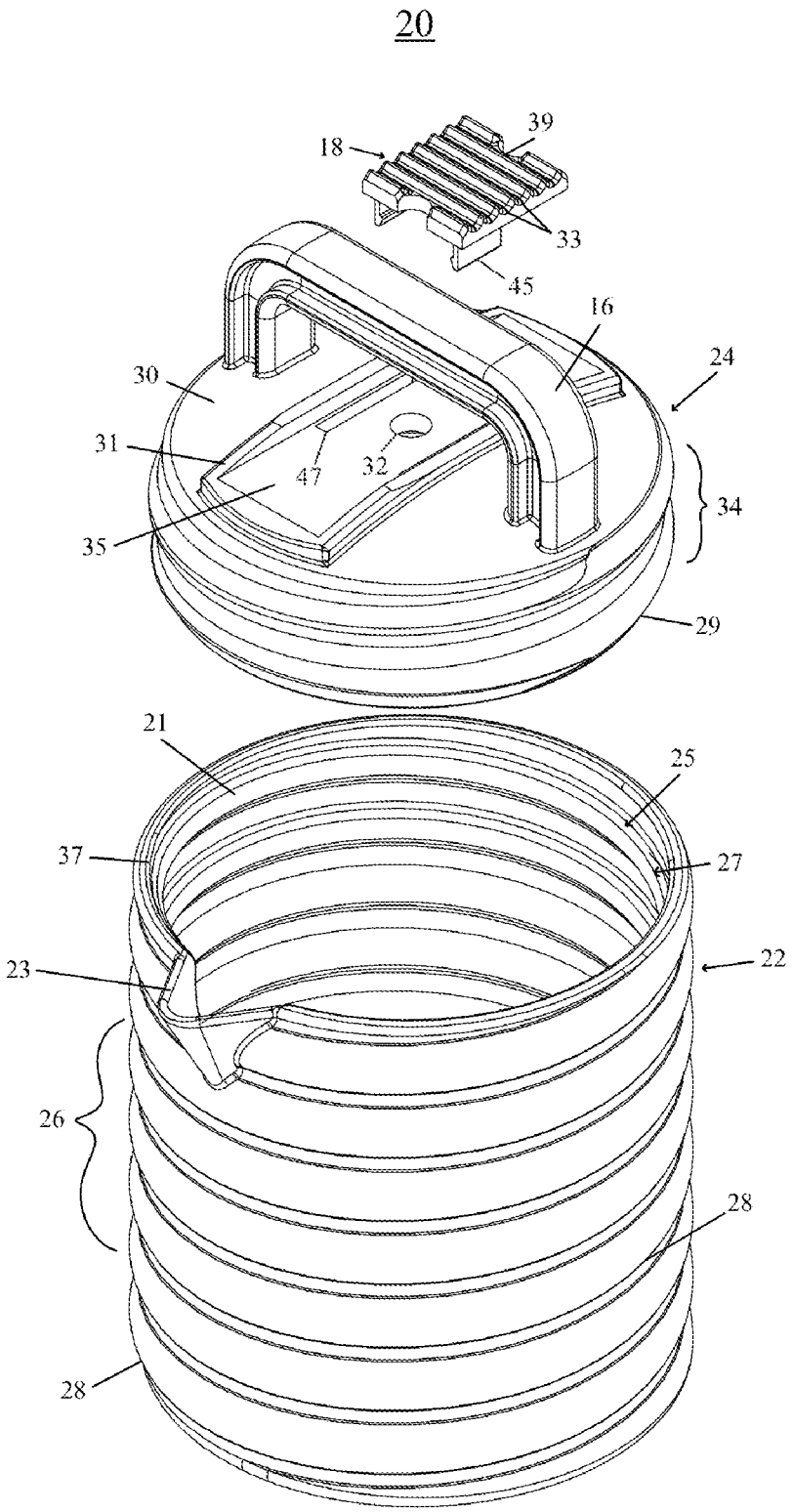
FIG. 2 is an exploded view, in perspective, of the variable volume evacuable container of FIG. 1.

FIG. 2 shows an exploded view, in perspective, of the variable volume evacuable container 20. In this embodiment, container 20 includes vessel 22 that is characterized by an open top 21, a spout 23 formed in the wall of the vessel at the open top, a spirally threaded inner wall 25, and a closed bottom. Threading 27 on the inner wall 25 provides the female part of a threaded coupling formed between the vessel 22 and lid 24. Threading 29 on the outer side wall 34 of the lid 24 provides the male part of the same threaded coupling. In one embodiment, the threading 29 on lid 24 consists of a single thread having no more than two spiral revolutions. In one implementation, the height of the outer side wall 34 is between about 1.0 in. and about 1.5 in. In another embodiment, the threading 27 on inner wall 25 may consist of a single thread having more than two spiral revolutions.

In another embodiment, the outer surface 26 of the vessel 22 may be corrugated to provide a gripping surface for a user's hand. For example, one or more grooves 28 may be formed on the outer surface 26 to create the corrugation. In one implementation of the corrugation, the grooves 28 may consist of one or more spiral grooves that are formed by compression of the outer surface 26, which compression simultaneously forms the threading 27 on the inner wall 25.

The lid 24 includes a track 31 that is formed on a top surface 30. The track 31 secures the baffle 18, while providing a horizontal area 35 along which the baffle 18 may slide while secure. One or more ridges 33 may be formed on a top surface of the baffle 18 to provide a frictional surface to facilitate movement of the baffle 18 along the sliding area 35 by force from a user's fingertip. A duct 32 located on the track 31 is defined through the top surface 30 of the lid 24, within the sliding area 35, to provide an evacuation port for fluid exiting the container 20. The sliding area 35 on track 31 defines an area greater than that of the baffle 18, so that the baffle 18 may be moved along the track 31 to a first position on area 35 at which the baffle 18 covers the duct 32, and so that the baffle 18 may be moved along the track 31 to a second position on area 35 at which the baffle 18 uncovers the duct 32. In one embodiment, the baffle 18 may be moved to a third position, laterally opposite the second position, at which baffle 18 also uncovers the duct 32. A cutout 39 may be formed on one or both ends of the baffle 18 and shaped to align with the shape of the duct 32.

Figure 3:
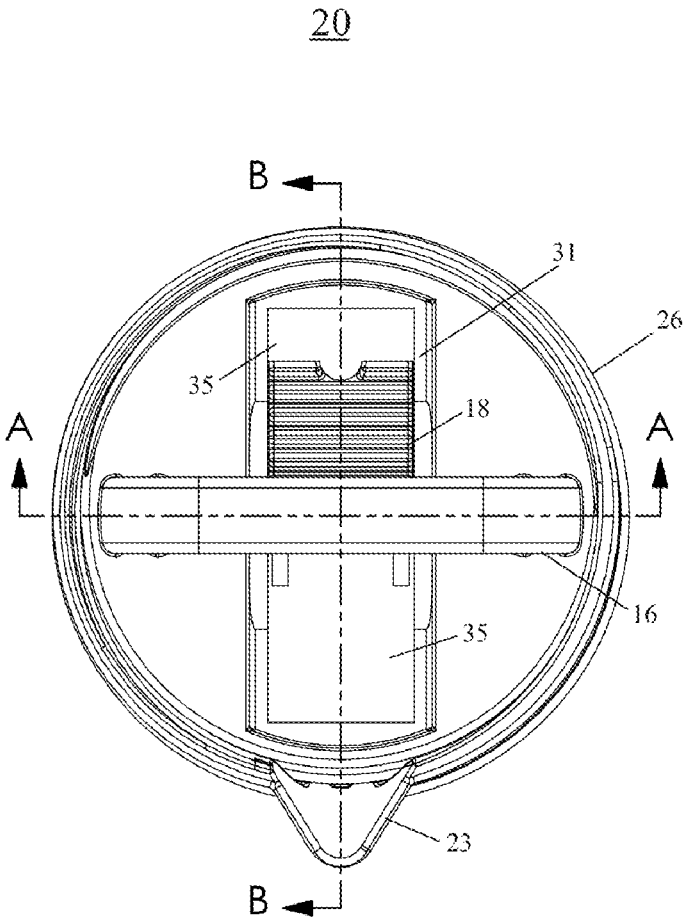
FIG. 3 is a top view of the variable volume evacuable container of FIG. 1.

FIG. 3 shows a top view of the variable volume evacuable container 10. The handle 16 is located on the top surface 30 and configured for grasping by one hand. In a preferred embodiment, the handle 16 is oriented so that its longitudinal axis (shown as the dashed line of Section line A-A) is substantially perpendicular to the longitudinal axis of the track 31 (shown as the dashed line of Section line B-B). This arrangement provides relatively unobstructed access for a user manipulating the baffle 18 to move it back and forth on area 35 along track 31. Other embodiments are possible in which the aforesaid axes of the handle 16 and track 31 are arranged to form angles other than perpendicular.

Figure 4:
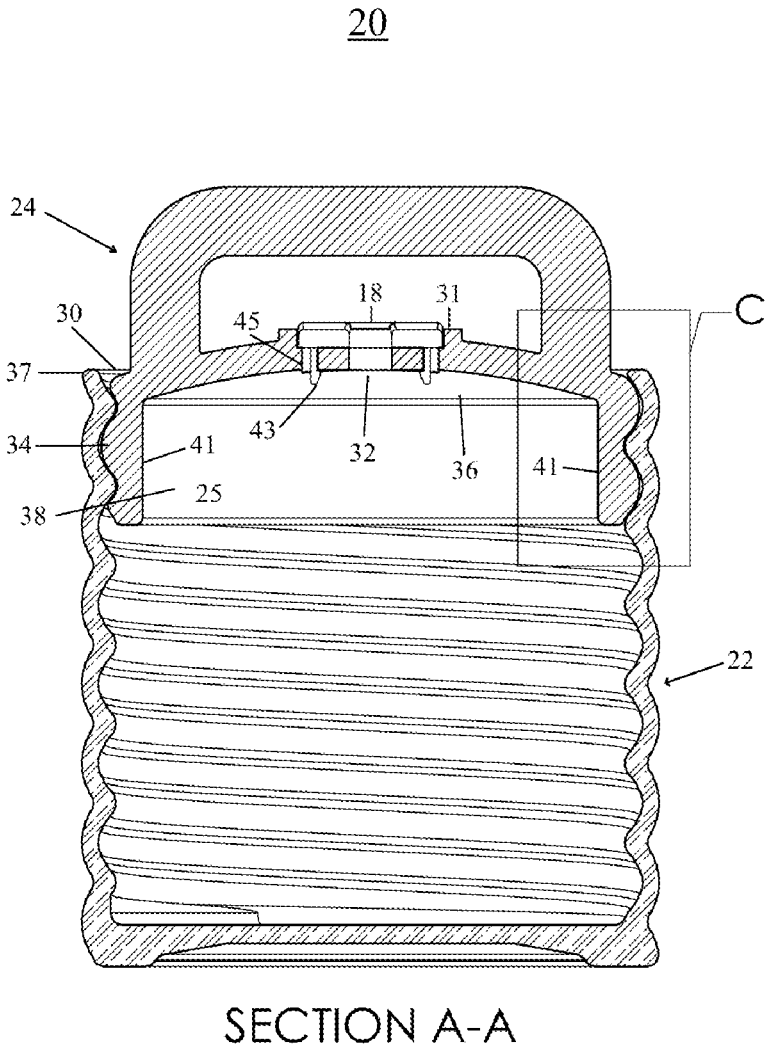
FIG. 4 is a cross-sectional side view of the variable volume evacuable container of FIG. 1 taken along section A-A.

FIG. 4 shows a cross-sectional side view of the variable volume evacuable container 20, taken along section A-A of FIG. 3. In this view, the container 20 is in an upright position, which is the correct orientation for containing liquid without causing spillage. The lid 24 is shown engaged within the vessel 22 at its top-most position. At the top-most position, the lid 24 has been screwed into the vessel 22 about one full revolution, so that the entirety of side wall 34 rests within the inner wall 25 of the vessel 22, and so that the top surface 30 of the lid 24 rests at substantially the same elevation as the top rim 37 of the vessel 22. With the lid 24 at its top-most position, the contained volume of the container 20 is at its maximum, and may be substantially equal to the volume of the uncovered vessel 22. In one embodiment, the maximum contained volume of the container 20 is about 750 milliliters, which is the volume of a Standard-sized bottle of wine. In other embodiments of the invention, the sizes of the various components of the container 20 may be scaled up or down, to achieve any desired maximum contained volume. For example, a container according to the invention may be scaled to achieve a maximum contained volume that corresponds to any of the popular bottle sizes for wine, such as Split (188 ml), Demi (375 ml), Standard (750 ml), Magnum (1.5 L), Double Magnum (3.0 L), Jeroboam (4.5 L), Imperial (6.0 L), Salmanazar (9.0 L), Balthazar (12.0 L), Nebuchadnezzar (15.0 L), etc.

According to the invention, the lid 24 is specially designed to force fluid upward through the duct 32 as the lid 24 is forced downward into the vessel 22. This is achieved by the geometry of the lid 24, which is configured to move vertically within the vessel 22 while substantially sealing liquid contained within the vessel from exposure to air outside the vessel 22, and to evacuate air vertically through the duct 32 by compression of a bottom surface 36 of the lid 24 against the contained liquid. Ideally, when the vessel 22 is partially filled with liquid and partially filled with air in the space above the liquid, the lid 22 is designed to reduce the contained volume of the vessel 22 and force substantially all of the contained air upward through the duct 32 by lowering the bottom surface 36 of the lid 22 into the vessel 22 until it contacts the upper surface of contained liquid. To ensure that substantially all of the air is evacuated through the duct 32, the bottom surface 36 has a generally concave shape, and the duct 32 is formed at the apex of the concavity, as shown. The bottom surface 36 may be formed with a diminishing or gradually diminishing upward slope as the gradient moves from the interior perimeter 41 of the side wall 34 toward the duct 32. In one embodiment, a diminishing or gradually diminishing upward slope may include a portion of the bottom surface that has no slope, i.e. an undefined slope or vertical slope, as shown at 41. For example, with reference to FIG. 4, moving upward from the no-slope portion at 41 and toward the duct 32, the upward slope diminishes when measured with respect to the horizontal. In this embodiment, the apex of the concavity, and therefore the duct 32, is located substantially centrally within the perimeter 37 of the lid.

As shown in FIG. 4, the specialized lid 24 defines a funneling volume 38 in the space beneath the bottom surface 36. The funneling volume 38 is best understood by imagining the lid 24 resting on a horizontal plane in an upright position (i.e. with the handle 16 at the top as shown). The funneling volume of the lid 24 is the volume beneath the bottom surface 36, within the interior perimeter 41, and above the horizontal plane. In one embodiment of the invention, to prevent formation of air pockets beneath the lid 24 and to promote evacuation of substantially all of the contained air as the bottom surface 36 compresses contained liquid, the bottom surface 36 is configured so that, with the slope of the bottom surface 36 being measured with respect to horizontal, any minimum length path along the perimeter 41 to the apex of the concavity slopes vertically and/or continuously upward to the apex. This geometry causes the contained liquid to displace all of the air from the funneling volume as the lid is lowered and the air is pushed out of the duct.

With reference again to FIG. 4, an embodiment of structure for moveably attaching the baffle 18 to the track 31 is shown. One or more rails 45 may extend downward from the lower surface of the baffle 18 and be sized to fit freely within one or more corresponding slots 47 that run parallel to the longitudinal axis of the track 31. Each rail 45 may be fitted on its distal end with a locking tab 45. Each locking tab 45 may consist of a half-arrow shaped wedge 43 disposed on one or both sides of the rail 45, as shown. The rails 45 may be formed as an integral part of the baffle 18, for example, from a resilient plastic that is pliable enough to compress the wedge 43 slightly to allow it to be forced by hand through the slot 47 distal-end first. Then when the wedge 43 clears the slot 47, the wedge springs back to its original width thereby locking the baffle 18 to the track 31 as the proximal end of the wedge abuts surface 36 and will resist any attempt to disconnect the baffle. Slots 47 are configured with a length and width to allow the baffle 18 to be freely moved along the track 31 to a first position in which it covers the duct 32 and to a second position in which is uncovers the duct 32.

Figure 5:
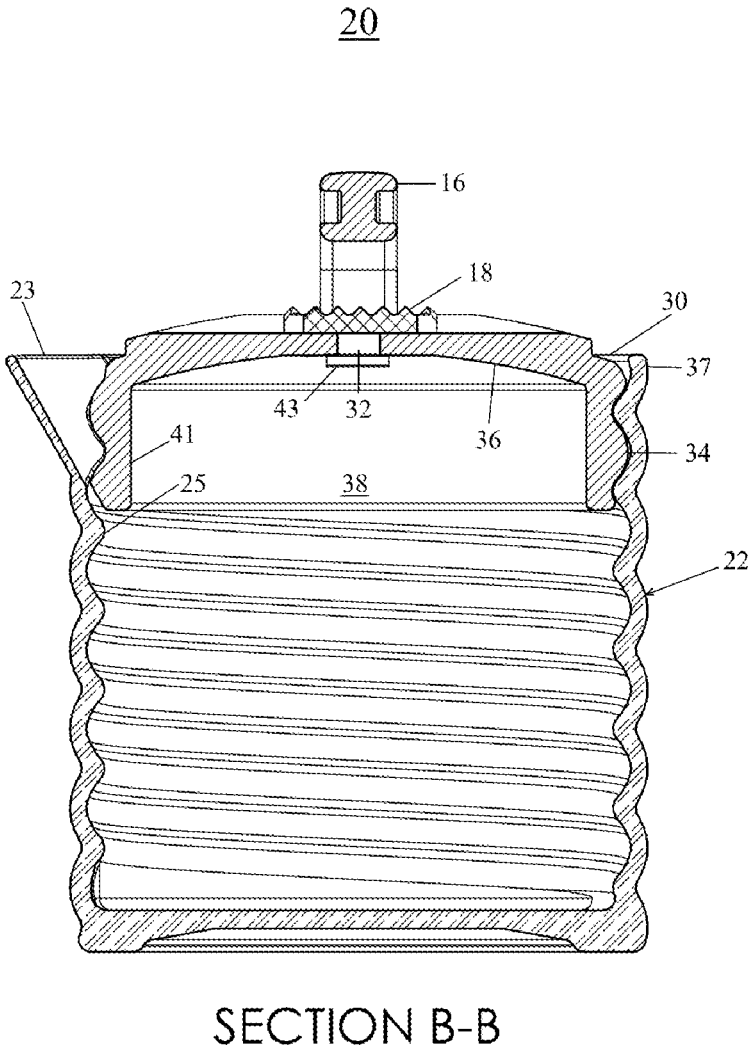
FIG. 5 is a cross-sectional side view of the variable volume evacuable container of FIG. 1 taken along section B-B.

FIG. 5 shows a cross-sectional side view of the variable volume evacuable container 20 taken along section B-B of FIG. 3. In this view, the container 20 is in the upright position, the lid 24 is in its top-most position, and the baffle 18 is in the first position in which it covers the duct 32. In an exemplary embodiment of the invention, the container 20, when configured as shown in FIG. 5 and devoid of liquid, is not designed to provide a completely air-tight seal between air within its contained volume and air in the ambient environment. For example, air under pressure may leak through a tiny pathway 51 located between the threading 27 and the threading 29, or through a tiny pathway located between the duct 32 and the baffle 18. The container 20 is designed, however, to seal such leakage pathways against the intrusion of air by using contained liquid as a barrier to form a minimized liquid/air interface. For example, with the container 20 partially filled with a liquid and resting in the upright position, the liquid will settle under force of gravity to a static level. A user may then gradually drive the lid 24 deeper into the vessel 12 by holding the outer surface 26 with one hand and rotating the handle 16 with the other hand. Eventually, the lid 24 will be driven until the liquid fills into the funneling volume 38 and into one or more of the leakage pathways, e.g. 51. In this condition, as long as the container 20 remains upright, the liquid will block air from entering the container via the leakage pathways. Such blockage will, at most, expose a miniscule amount of contained liquid to air at the blockage interface. The surface area of liquid so exposed is thereby minimized to ensure insignificant oxidation of the liquid relative to the contained volume.

The minimized liquid/air interface as described above is achieved by a moveable environmental seal configured according to the present invention. The moveable environmental seal solves an important problem of competing objectives that arises when designing a manually operated variable volume evacuable container. One objective is to design a moveable component, such as a lid, that can expand or contract the volume of the container according to the position of the moveable component within the vessel. A competing objective is to design the moveable component so that in any position the component provides an environmental seal to prevent leakage of air or liquid into or out of the container. For a manually operated container, these objectives are at odds because the tighter the seal, the greater the friction between the moveable component and the vessel, and hence the greater the difficulty a user encounters when moving the component within the vessel. Conversely, reducing the friction between the moveable component and the vessel allows for easier manual operation, but only at the expense of greater leakage through the seal.

Accordingly, the moveable environmental seal provided by the present invention can be expressed as any configuration of the moveable component and vessel whereby (1) the frictional force opposing movement of the moveable component is less than a desired force threshold and (2) the flow rate of water leaving the vessel when full and oriented in an inverted (i.e. upside-down) position with the moveable component installed its top-most position is less than a desired leakage threshold. For example, in one embodiment, a container 20 having a maximum contained volume of 25 fl. oz. (750 ml) is configured with a moveable environmental seal that satisfies a maximum force threshold of 10.0 lbf (13.6 Nm) and a maximum leakage threshold of 0.20 gpm (0.76 lpm). In another embodiment, a container 20 is configured with a moveable environmental seal that satisfies a force threshold between about 5.0 lbf (6.8 Nm) and about 15.0 lbf (20.3 Nm), and a leakage threshold between about 0.10 gpm (0.38 lpm) and about 0.3 gpm (1.14 lpm). In another embodiment, a container 20 configured according to the invention has ratings of 2.0 lbf+/−10% and 0.4 gpm+/−10%. Skilled artisans will recognize that other embodiments of the invention are possible in which moveable environmental seals are expressed as a combination of force thresholds and leakage thresholds, which may vary according to the volume and configuration of the container.

In normal operation of a container according to the invention, the force threshold is an important design consideration, as it determines how much manual torque is required for a user to move the lid 24 into and out of the vessel 22. The leakage threshold also characterizes the configuration of the container; however, in normal use, the container will remain in an upright position and should not leak any liquid out of containment. According to the invention, a small amount of leakage through the duct 32 at pathway 52 is desirable, to provide a visual indication to the user that substantially all air has been evacuated from the vessel, and thus signal the user to stop driving the lid 24 into the container interior. Desired leakage may also occur at pathway 51, which may similarly signal the user. In one embodiment, the baffle 18, track 31, and duct 32 may be omitted from the structure of the container 20, and desired indication of leakage may occur only through pathway 51. The leakage threshold may also be selected to minimize spillage when a container according to the invention is accidentally tipped over during abnormal usage.

In another embodiment, the threaded connection between the outer side wall 34 and the inner wall 25 provides an excellent seal against liquid leakage at ambient pressures, so that all desired leakage occurs through the duct 32 as the lid 24 is driven deeper into the liquid-filled container while the baffle 18 is in the second position. Such a seal may be achieved by using a pliable synthetic rubber or plastic material for forming the lid 25, and a rigid material such as stainless steel for forming the vessel 22. In such an embodiment, manufacturing tolerances for the threaded dimensions on the lid 25 may be adjusted to ensure frictional interference with the threaded dimensions of the vessel 22. The mechanical advantage provided to a user by the configuration of handle 16 allows the user to overcome the frictional interference and screw the lid manually into and out of the vessel.

Figure 6:
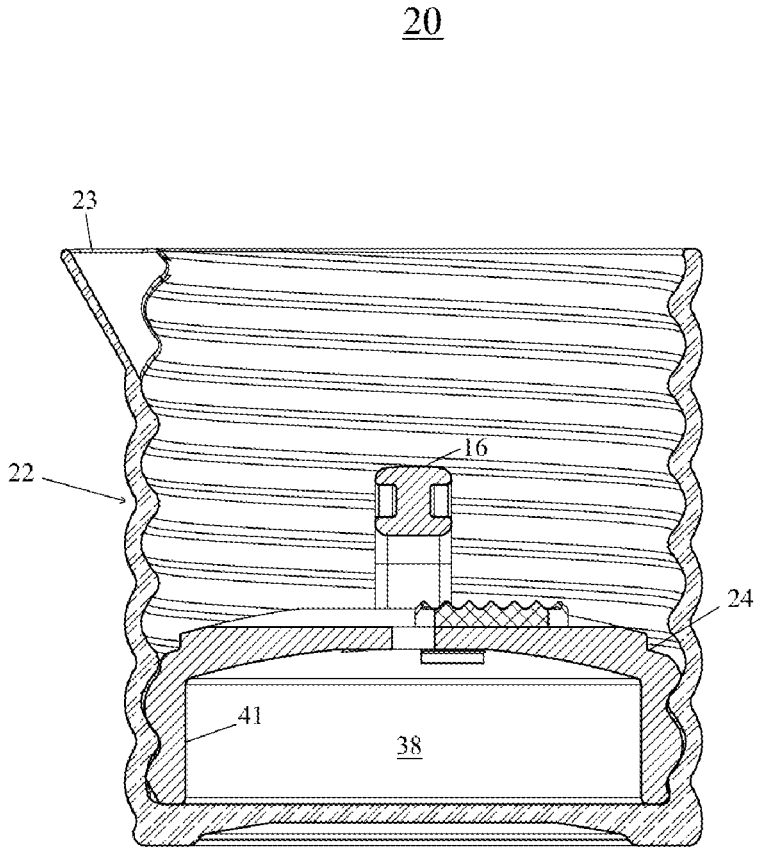
FIG. 6 is a cross-sectional side view of the variable volume evacuable container of FIG. 1 with the lid moved to a bottom-most position within the container.

FIG. 6 shows a cross-sectional side view of the variable volume evacuable container 20 with the lid 24 moved to its bottom-most position within the container. The container 20 is configured so that the lid 24 may rest statically at any intermediate position within the vessel 22 between the top-most position and the bottom-most position. However, showing the lid 24 resting at the bottom-most position illustrates the importance of configuring the container with a minimum inner width or inner diameter that will provide adequate space for an average-sized human hand to reach into the bottom of the vessel to grasp the handle 16 firmly without interference from the inner wall 25. To meet this objective, in one embodiment, the container 20 has a minimum inner diameter (i.e. interior width of the open top 21, excluding the area of the spout 23) of about 4.0 inches. In the same or another embodiment, the container may have a minimum height of about 5 inches. Also with the lid 24 in the bottom-most position, the contained volume has been reduced to an amount substantially equivalent to the funneling volume 38. In one embodiment, the funneling volume 38 is limited to about 5 fl. oz (150 ml), which is the standard pour for a single glass of wine. Any volume less than the standard pour might as well be imbibed, rather than stored.

Figure 7:
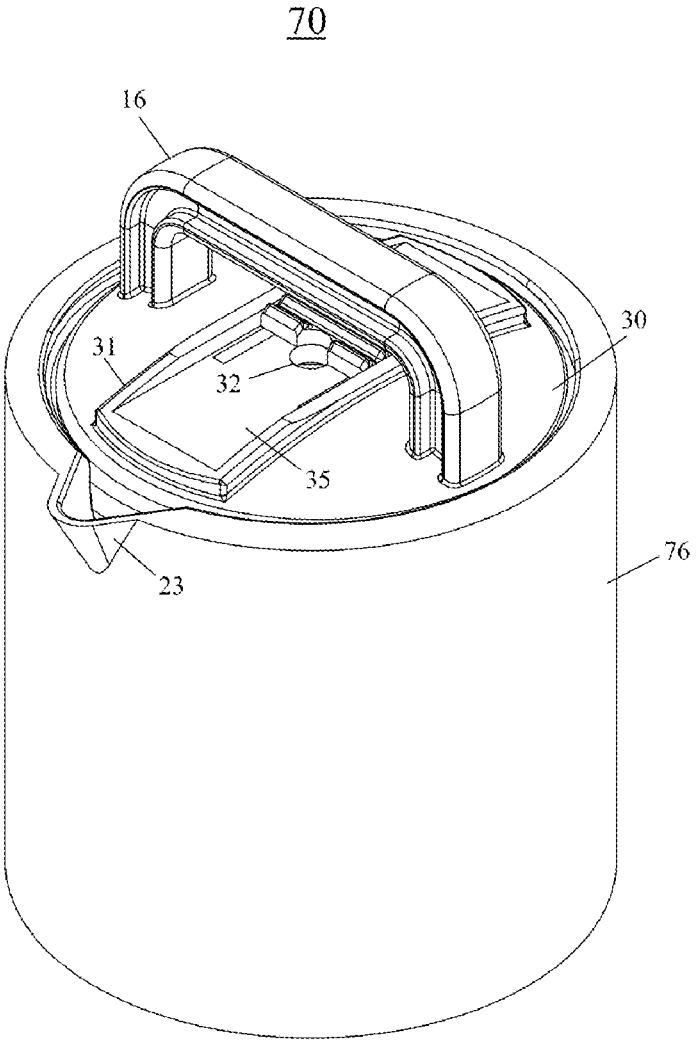
FIG. 7 is a perspective view of another embodiment of a variable volume evacuable container according to the present invention.

FIG. 7 shows a perspective view of another embodiment of a variable volume evacuable container 70 according to the present invention. In this embodiment, the outer surface 76 of the vessel 72 is made smooth, without corrugations or ridges. The smooth outer surface 76 is suitable for containers 70 that have an outer width or diameter small enough to be grasped firmly by a user's hand. In one embodiment, the diameter of vessel 72 is between about 4.0 inches and about 6.0 inches.

Figure 8:
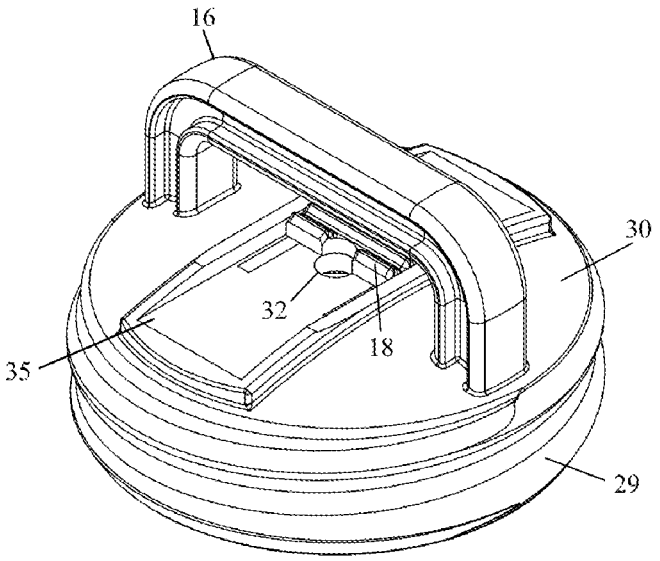
FIG. 8 is a perspective view of a lid according to the invention for use with the container of FIG. 6.

FIG. 8 shows a perspective view of a lid 24 according to the invention for use with container 20 or 70. This view illustrates the baffle 18 resting in its second position on area 35 at which the baffle 18 uncovers the duct 32. In one embodiment, the baffle 18 is friction-fit and mechanically contained within the track 31 and free to rest statically at any intermediate position between its first and second positions. The friction fit is sufficient to maintain the baffle 18 in any such resting position, while allowing a user to easily move the baffle among its positions by manual force applied by a user's fingertip. The friction-fit may be achieved, for example, by ensuring that a width between opposing rails 45 slightly exceeds or is less than a width between complementary opposing slots 47.

Figure 9:
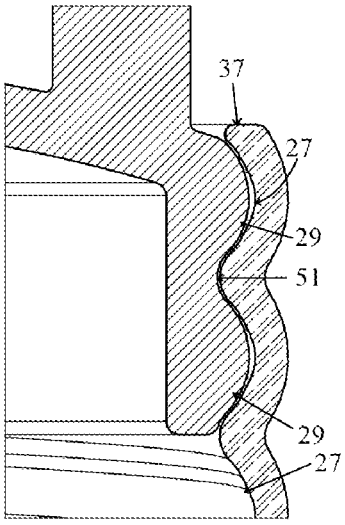
FIG. 9 is a magnified cross-sectional view of area C of FIG. 4.

FIG. 9 shows a magnified cross-sectional view of area C of FIG. 4. This view illustrates the location of the leakage pathway 51 that is continuously open between the male threading 29 on the outer side wall of the lid 24, and the female threading 27 on the inner wall 25 of the vessel 22. According to the invention, the friction fit between threading 27 and threading 29 minimizes the leakage of contained fluid through passage 51 while allowing manual translation of the lid 25 into the vessel 22 without undue difficulty. In one embodiment, the pitch of threading 27 and 29 is about 0.5 inches, with a major diameter of about 4.6 in. and a minor diameter of about 4.0 inches.

Exemplary embodiments of the invention have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that that scope shall not be restricted, except in light of the appended claims and their equivalents.

What is claimed is:

1. A container, comprising:

a hollow cylinder having a closed bottom, an open top, and a spirally threaded inner wall extending between the closed bottom and the open top;

a lid configured to threadably engage the inner wall of the hollow cylinder and substantially seal liquid contained within the cylinder from exposure to air outside the cylinder, the lid having a center, a top surface, a perimeter, and a bottom surface; and a leakage pathway formed between the perimeter of the lid and the inner wall;

the lid further configured to evacuate air from the hollow cylinder through the leakage pathway by compression of the lid against the liquid contained in the cylinder;

the leakage pathway continuously open between the perimeter of the lid and the inner wall as the lid compresses the liquid to permit leakage of the liquid through the leakage pathway to provide a visual indication of the leakage at the top surface of the lid.

2. The container of claim 1, further comprising a handle formed on the top surface.

3. The container of claim 1, wherein the lid comprises a threaded side wall.

4. The container of claim 3, wherein the open top further comprises a spout having a height less than a maximum height of the threaded side wall.

5. The container of claim 3, wherein the threaded side wall includes a thread having no greater than two spiral revolutions.

6. The container of claim 1, wherein the bottom surface is substantially concave.

7. The container of claim 1, further comprising an outer wall extending between the closed bottom and the open top, the outer wall at least partially corrugated.

8. The container of claim 1, configured to allow the lid when threadably engaged to the inner wall of the hollow cylinder to be rotated downward into the hollow cylinder until the perimeter of the lid contacts the closed bottom and to be rotated upward out of the hollow cylinder until the lid separates from the hollow cylinder.

9. A variable volume liquid container, comprising:

a hollow vessel having a closed bottom, an open top, and an inner wall extending between the closed bottom and the open top;

a lid having a center, a top surface, a perimeter, and a bottom surface; and a leakage pathway formed between the perimeter and the inner wall;

the lid configured to move vertically within the hollow vessel while substantially sealing liquid contained within the vessel from exposure to air outside the vessel, and further configured to evacuate air from the hollow vessel through the leakage pathway by compression of the lid against the liquid; and the lid further configured to continuously maintain the leakage pathway open between the perimeter of the lid and the inner wall of the vessel as the lid compresses the liquid to cause a desired indication of leakage of the liquid at the leakage pathway.

10. The container of claim 9, further comprising a handle formed on the lid.

11. The container of claim 9, wherein the open top further comprises a spout.

12. The container of claim 9, wherein the bottom surface is substantially concave.

13. The container of claim 9, configured to allow the lid to be moved downward into the hollow vessel until the perimeter of the lid contacts the closed bottom, and to be moved upward from the closed bottom until the lid separates from the hollow vessel.

14. The container of claim 1, further comprising a passage for desired leakage of fluid forced upward through the cylinder by downward movement of the lid into the cylinder, the passage formed between the perimeter of the lid and the inner wall of the cylinder.

15. A variable volume liquid container, comprising:

a hollow vessel having a closed bottom, an open top, and an inner wall extending between the closed bottom and the open top; and a lid configured to move vertically within the hollow vessel while substantially sealing liquid contained within the vessel from exposure to air outside the vessel, the lid having a top surface and a perimeter, and configured to evacuate air from the hollow vessel through a leakage pathway by compression of the lid against the liquid;

the leakage pathway continuously open between the perimeter of the lid and the inner wall of the vessel as the lid compresses the liquid to permit leakage of the liquid through the leakage pathway and thereby provide a visual indication of the leakage between the top surface of the lid and the inner wall of the hollow vessel.

* * * * *